US006742601B2

(12) United States Patent
Numata

(10) Patent No.: US 6,742,601 B2
(45) Date of Patent: Jun. 1, 2004

(54) BATTERY POWERED TOOLS

(75) Inventor: Fumitoshi Numata, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/014,923

(22) Filed: Dec. 14, 2001

(65) Prior Publication Data

US 2002/0100597 A1 Aug. 1, 2002

(30) Foreign Application Priority Data

Dec. 15, 2000 (JP) ..... 2000-382374

(51) Int. Cl.[7] ..... E21B 23/02
(52) U.S. Cl. ..... 173/217; 173/216; 173/170
(58) Field of Search ..... 173/217, 216, 173/160, 156, 166, 170; 227/126; 310/47, 50

(56) References Cited

U.S. PATENT DOCUMENTS 3,212,938 A 10/1965 Neuhardt et al.
3,746,813 A * 7/1973 Brown ..... 200/43.17
3,847,233 A * 11/1974 Glover et al. ..... 173/170
3,883,789 A * 5/1975 Achenbach et al. ..... 429/9
3,943,934 A * 3/1976 Bent ..... 606/178
4,097,705 A * 6/1978 Harvell ..... 307/126
4,751,452 A * 6/1988 Kilmer et al. ..... 320/106
5,089,738 A * 2/1992 Bergqvist et al. ..... 310/50
5,136,130 A * 8/1992 Daly ..... 200/318.1
5,311,949 A * 5/1994 Chapin ..... 173/217
5,360,073 A * 11/1994 Akazawa ..... 173/15
5,638,945 A 6/1997 Fukinuki et al.
5,653,296 A * 8/1997 Fujiyama ..... 173/217
5,881,823 A * 3/1999 Kabatnik et al. ..... 173/217
5,918,685 A * 7/1999 Ulbrich et al. ..... 173/4
6,181,032 B1 1/2001 Marshall et al.

FOREIGN PATENT DOCUMENTS

DE 3825654 2/1990

* cited by examiner

*Primary Examiner*—Scott A. Smith
*Assistant Examiner*—Nathaniel Chukwurah
(74) *Attorney, Agent, or Firm*—Dennison, Schultz & Dougherty

(57) ABSTRACT

A power tool (1) includes a tool body (3) on which a battery (10) as a power source is mounted. A switch (7) is electrically connected to the battery for supplying power to a motor (6) that is disposed within the tool body. An ON lock mechanism (12,20) serves to lock the switch in an ON position. The ON lock state of the switch can be released or the switch can be turned OFF when the battery is removed from the power tool.

20 Claims, 6 Drawing Sheets

BATTERY POWERED TOOLS

This application claims priority to Japanese application serial number 2000-382374, which application is hereby incorporated by reference herein in its entirety.

BACKGROUND OF THE INVENTION

1. Field of the Invention

The present invention relates to power tools, and in particular to power tools that are driven by batteries, e.g., rechargeable batteries, as a power source. More particularly, the present invention relates to switches for operating a power tool motor driven by a battery power source.

2. Description of the Related Art

Known power tools are capable of being driven by either an AC power source or a DC power source. Generally speaking, rechargeable batteries have been used as the DC power source. In order to enable longtime continuous operation, some power tools that are driven by an AC power source (hereinafter called "AC power tools") have an ON lock mechanism for locking a motor switch in an ON position. The ON lock mechanism allows the power tool to be continuously operated without being required to hold the motor switch. However, power tools that are driven by batteries (hereinafter called "DC power tools") generally do not include an ON lock mechanism in order to (1) avoid wasteful discharge of the batteries and/or (2) prevent the power tool from being accidentally driven if the recharged batteries are mounted on or inserted into the power tool while the ON lock mechanism is in the ON position. In recent years, however, the quality of rechargeable batteries has considerably improved and rechargeable batteries now provide a relatively long usable time. Therefore, DC powered tools having ON lock mechanisms also have been proposed.

Such known battery powered tools with ON lock mechanisms have been designed such that the battery (or a battery pack) can be removed while the motor switch is still locked in the ON position. Further, known power tools have been designed to prevent the motor from being accidentally driven when the recharged batteries are again mounted on the tool.

For example, Japanese Utility Model Publication No. 3-18148 teaches a DC power tool that has an ON lock mechanism and an ON lock releasing mechanism. When the batteries have been discharged, the batteries are typically removed from the tool for recharging. During this removal step, the motor switch is held in the ON position by the ON lock mechanism. The ON lock releasing mechanism only releases the ON state of a motor switch when the recharged batteries are re-mounted on the tool.

However, because the known ON lock releasing mechanism releases the ON state only when the recharged batteries have been re-mounted, the motor switch is held ON after the discharged batteries have been removed. As a result, the operator may not be certain as to whether or not the ON lock releasing mechanism will reliably operate when the recharged batteries have been re-mounted. Therefore, the operator is sometimes required to manually turn OFF the motor switch before the recharged batteries are re-mounted, thereby making the known ON lock releasing mechanism inconvenient to use.

SUMMARY OF THE INVENTION

It is, accordingly, one object of the present invention to teach improved DC power tools. For example, in one aspect of the present teachings, the power tools may provide improved operability and convenience compared to known DC power tools.

In one embodiment of the present teachings, power tools may include a power source, e.g., a rechargeable battery, mounted on a tool body. A switch may be electrically connected to the battery in order to supply power to a motor that may be disposed within the tool body. An ON lock mechanism may serve to lock the switch in an ON position during operation of the power tool. The ON lock state of the switch preferably may be released (or the switch may be turned OFF) when the battery is removed from the power tool. More preferably, the switch is automatically (i.e., without operator assistance) released or turned OFF when the battery is removed from the power tool, e.g., for recharging.

Thus, when the operator removes the battery in order to recharge the battery, the switch may be automatically turned OFF. Therefore, the motor may be reliably prevented from being accidentally driven when the operator re-mounts the recharged battery on the power tool. Preferably, the power tool is designed so that the operator can visually recognize that the switch is turned OFF. As a result, the operability and convenience of the power tool can be improved and the operator can be certain that the motor will not be accidentally driven when the battery is re-mounted on the power tool.

Preferably, the ON lock mechanism prevents the switch from being locked in the ON position as long as the battery is not mounted on the power tool. Therefore, the switch can be reliably prevented from being set in the ON position when the battery is re-mounted on the power tool.

In another embodiment, the ON lock mechanism may include a detection rod that can change position in response to the presence or non-presence of the battery within a battery mounting space defined in the tool body. When the battery is set or mounted in the battery mounting space, the detection rod may be positioned in a first position, so that the detection rod can cooperate with a switch lever to lock the switch in the ON position. On the other hand, when the battery has been removed from the battery mounting space, the detection rod may automatically move from the first position to a second position. As a result, the ON lock state of the switch preferably will be released by such movement of the detection rod.

More preferably, the switch may automatically move to the OFF position as the detection rod moves to the second position. Therefore, if the detection rod is an element of the ON lock mechanism, the detection rod also may serve to release the ON lock state, so that the power tool may have a relatively simple design.

Additional objects, features and advantages of the present invention will be readily understood after reading the following detailed description together with the accompanying drawings and the claims.

DETAILED DESCRIPTION OF THE INVENTION

Figure 1:
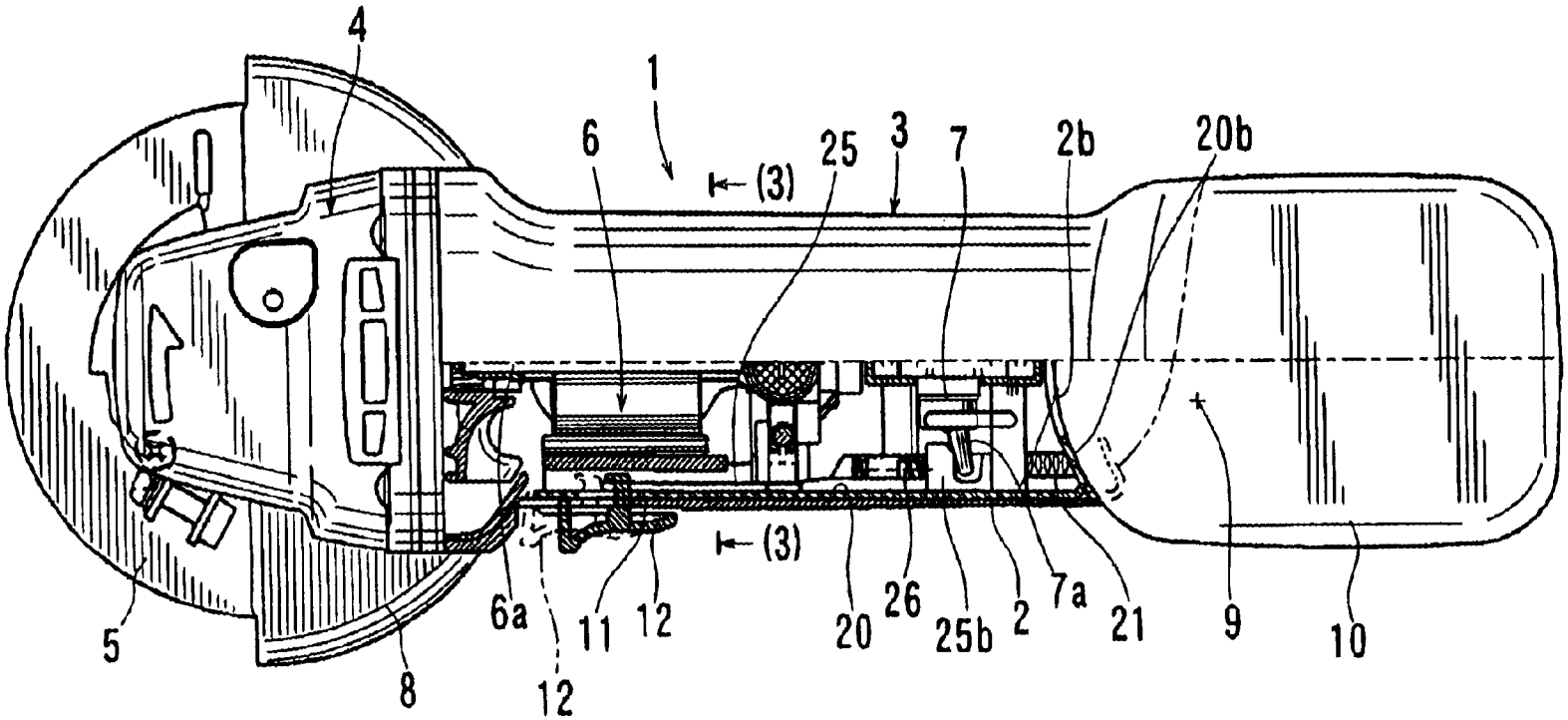
FIG. 1 is a broken-away plan view of a representative grinder that is driven by a battery as a DC power source, in which the battery has been mounted on or within the grinder.

In one embodiment of the present teachings, power tools are taught that may include a body having an electric motor and a battery mounting space for receiving a battery. A switch may be electrically connected to the motor and may move between an ON position and an OFF position for starting and stopping the motor, respectively. An ON lock mechanism may serve to lock the switch in the ON position. Preferably, the ON lock state of the switch may be (automatically) released in response to removal of the battery from the power tool.

Preferably, the ON lock mechanism may be operable by an operator to lock the switch in the ON position. Further, the switch also can be automatically released from the ON lock state to return to the OFF position when the battery is removed from the power tool. More preferably, the ON lock mechanism may be operable to prevent the switch from being held in the ON lock position as long as the battery is removed from the power tool.

In another embodiment, the ON lock mechanism may include a detection member that can detect whether or not the battery is set on the power tool. In this case, the ON lock mechanism may be operable to permit the switch to be locked in the ON position or to prevent the switch from being hold in the ON position in response to detection of the battery by the detection member. The detection member may be, e.g., a detection rod that is movable between a first position for permitting the switch to be locked in the ON position and a second position for preventing the switch from being held in the ON position.

In another embodiment, the detection member may retract from and extend into the battery mounting space when the detection member is in the first position and the second position, respectively. In this case, insertion of the battery into the battery mounting space will cause the detection member to move from the second position to the first position while the battery is being mounted within the battery mounting space. For example, the battery may actively push the detection member from the second position to the first position when the battery is inserted into the battery mounting space.

In another embodiment, a first biasing member may bias the detection member toward the second position. Further, the ON lock mechanism may also include a switch lever that is associated with the switch. The switch lever may have an engaging arm that can engage the detection member so as to lock the switch in the ON position when the detection member is in the first position.

In another embodiment, a switch rod may be coupled to the switch, so that the switch lever can shift the switch between the ON position and the OFF position via the switch rod. Further, a second biasing member may be associated with the switch lever, which second biasing member may bias the switch rod toward the direction for turning OFF the switch. Preferably, the second biasing member also serves to hold the engaging arm of the switch lever in engagement with the detection rod.

In another embodiment, the detection member may disengage from the engaging arm of the switch lever so as to release the ON lock state of the switch when the detection member moves from the second position to the first position.

Each of the additional features and method steps disclosed above and below may be utilized separately or in conjunction with other features and method steps to provide improved power tools and methods for designing and using such power tools. Representative examples of the present invention, which examples utilize many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and dependent claims may be combined in ways that are not specifically enumerated in order to provide additional useful embodiments of the present teachings.

A representative embodiment of a DC power tool will now be described with reference to FIGS. 1 to 9. A representative battery driven grinder 1 may include a substantially hollow body (housing) 3 that further includes a substantially cylindrical handle casing 2, so that an operator can easily grasp the handle casing 2 during a grinding operation. A gear casing (housing) 4 may be secured to the front end of the body 3 (left end as viewed in FIG. 1). A gear transmission mechanism may be disposed within the gear casing 4 and may include a bevel gear train (not shown). The gear transmission mechanism preferably serves to transmit the rotation of a motor 6 to a grinding disk (tool) 5. The motor 6 may be disposed within the handle casing 2 and may be electrically connected to a switch 7, so that the motor 6 can be started and stopped when the switch 7 is respectively turned ON and OFF.

The switch 7 may have an operation knob 7*a* that can pivot between an ON position and an OFF position for turning ON and OFF the switch 7. More specifically, the switch 7 may be turned ON and OFF when the knob 7*a* has pivoted to a left side position and a right side position as viewed in FIG. 1, respectively. FIG. 1 shows the state in which the knob 7*a* has been pivoted to the right side (OFF) position.

When the motor 6 is started, the rotation of an output shaft 6*a* of the motor 6 may be transmitted to a spindle (not shown) on which the grinding disk 5 is mounted. As a result, the grinding disk 5 will rotate. The spindle may extend substantially perpendicular to the output shaft 6*a*. A disk cover 8 may be attached to the gear casing 4 and may serve to cover about one-half of the grinding disk 5 in order to protect the operator's hand.

Preferably, an ON lock mechanism may serve to lock the switch 7 in an ON position (hereinafter called the "ON lock state"), which will keep the motor 6 rotating. The ON lock state may be released by an ON lock releasing mechanism. The ON lock mechanism and the ON lock releasing mechanism will be further described below.

The rear portion of the handle casing 3 may define a battery mounting space 9 and may serve to receive a battery 10 or another DC power source. Preferably, the battery 10 may be a rechargeable battery that can be repeatedly re-charged after having been discharged. Thus, the battery 10 may be repeatedly re-charged to supply power to the motor 6. Preferably, the battery 10 may be detachably mounted within the battery mounting space 9 so as to enable the battery 10 to be removed from the mounting portion 9 for the purpose of recharging.

The ON lock mechanism may include, e.g., a switch lever 12. The switch lever 12 may slidably shift in the forward and rearward directions (left and right directions) along a flat guide surface 11 that is defined on a side surface of the handle casing 3. The guide surface 11 and the switch lever 12 are shown in more detail in FIGS. 4 and 5.

A slot 11*a* may be defined within the handle casing 3 along the wall of the handle casing 3 and may be elongated in the forward and leftward directions. A pair of guide projections 13 may be formed on an outer surface of the handle casing 3 and along both sides of the slot 11*a*. Each of the guide projections 13 may have an upper surface that may include a substantially flat surface 13*a* and an inclined surface 13*b*. The flat surface 13*a* may extend substantially in parallel to the longitudinal axis of the handle casing 3. The inclined surface 13*b* may extend forward (leftward as viewed in FIGS. 4 and 5) from the flat surface 13*a* and may have a height that decreases towards the forward direction. In other word, the inclined surface 13*b* may incline downward toward the outer surface of the handle casing 3.

Preferably, the switch lever 12 may include an actuation arm 12*a* that extends from a substantially middle portion of the switch lever 12. The actuation arm 12*a* may extend into the inner space formed within the handle casing 3 through the slot 11*a*. A substantially arc-shaped projection 12*c* may be formed on the outer, front portion of the actuation arm 12*a* and may serve as a pivotal fulcrum, so that the switch lever 12 can pivot relative to the handle casing 3 about the projection 12*c*.

An engaging arm 12*b* may extend from the front end of the switch lever 12 in a direction toward the handle casing 3 or substantially parallel to the actuation arm 12*a*. The engaging arm 12*b* also may extend into the slot 11*a*.

Figure 3:
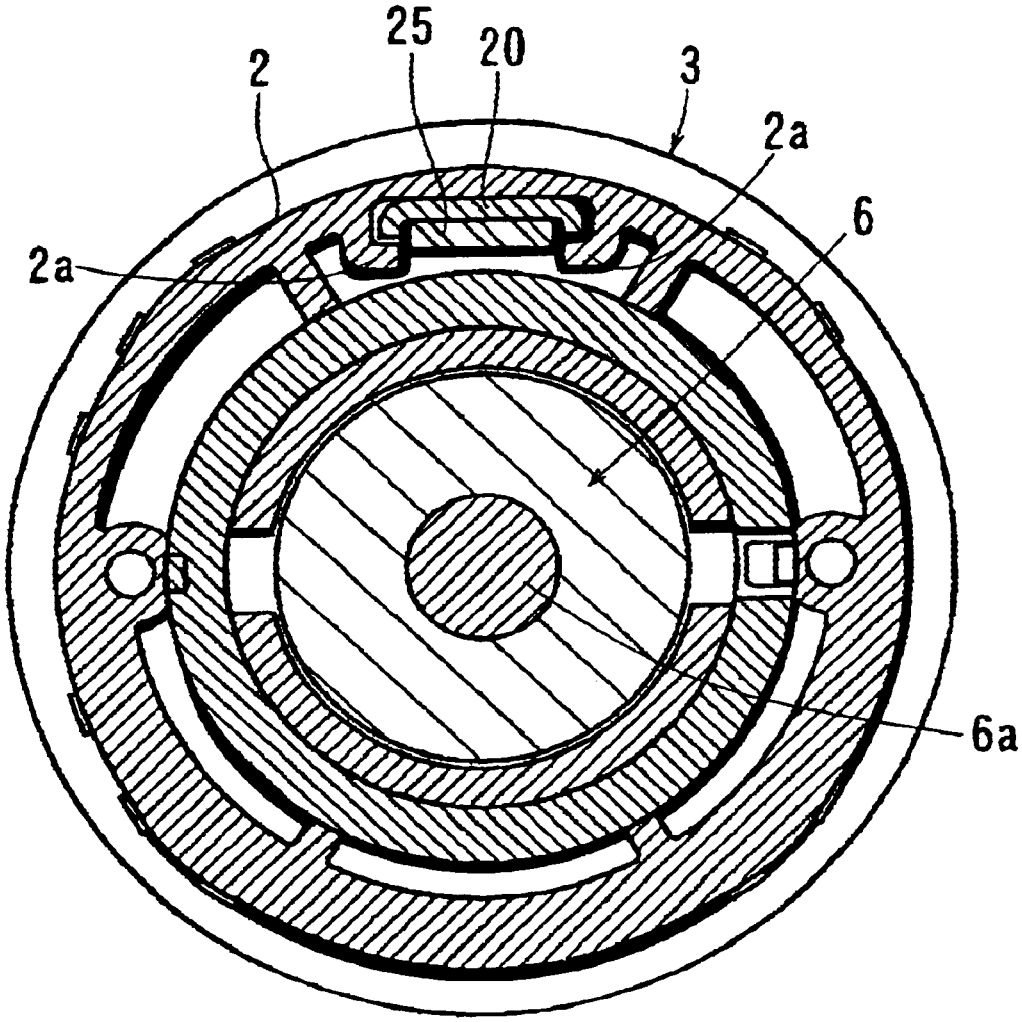
FIG. 3 is a vertical, cross-sectional view of the grinder taken along line (3)—(3) shown in FIG. 1.

A detection rod 20 may preferably be made of an elongated strip and may be disposed within the handle casing 3. The detection rod 20 may extend along the inner wall of the handle casing 3 and may have a front portion that is positioned opposite to the slot 11*a*. A switch rod 25 also may be made of an elongated strip. The switch rod 25 may be disposed inside of the detection rod 20 and may slide relative to the detecting rod 20. As shown in FIG. 3, a pair of guide rails 2*a* may be formed integrally with the inner surface of the handle casing 3 and may be disposed along both sides of the slot 11*a*. More specifically, the guide rails 2*a* may have respective inner ends or projections that are bent toward each other. Therefore, the guide rails 2*a* may serve to guide the detecting rod 20 and the switch rod 25. As a result, the detection rod 20 and the switch rod 25 can slide relative to the handle casing 3 and also relative to each other in the forward and rearward directions (left and right directions as viewed in FIGS. 4 and 5).

Figure 2:
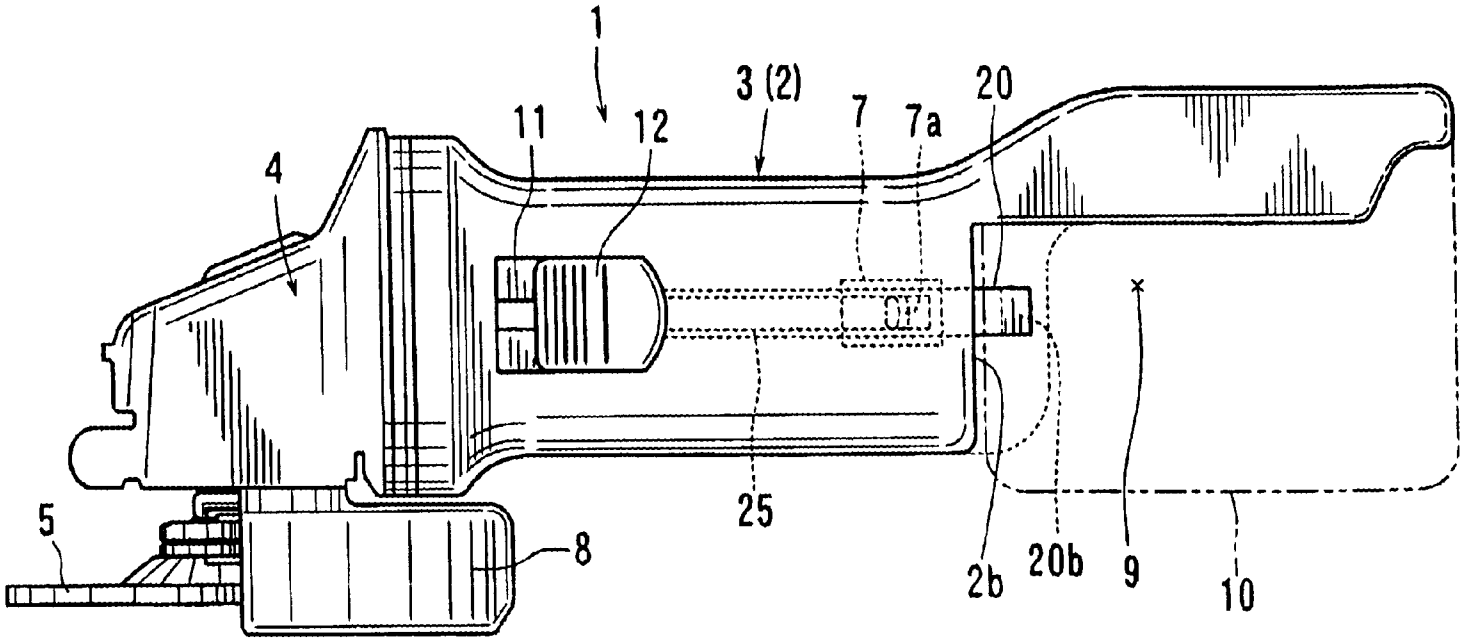
FIG. 2 is a side view of the grinder, in which the battery has been removed.

As shown in FIGS. 1 and 2, the rear end of the detection rod 20 may extend outward from a rear edge 2*b* of the handle casing 3, which rear edge may define the front end of a battery mounting space 9, so that the detection rod 20 may extend into the battery mounting space 9. As shown in FIG. 1, the rear end of the detection rod 20 may be bent toward the interior of the handle casing 3 (upward as viewed in FIG. 1) in an L-shaped configuration to form a detection end 20*b*. A compression spring 21 may be interposed between the rear edge 2*b* of the handle casing 3 and the detection end 20*b*, so that the detection rod 20 is biased in a rearward direction or the direction that extends into the battery mounting space 9.

Figure 4:
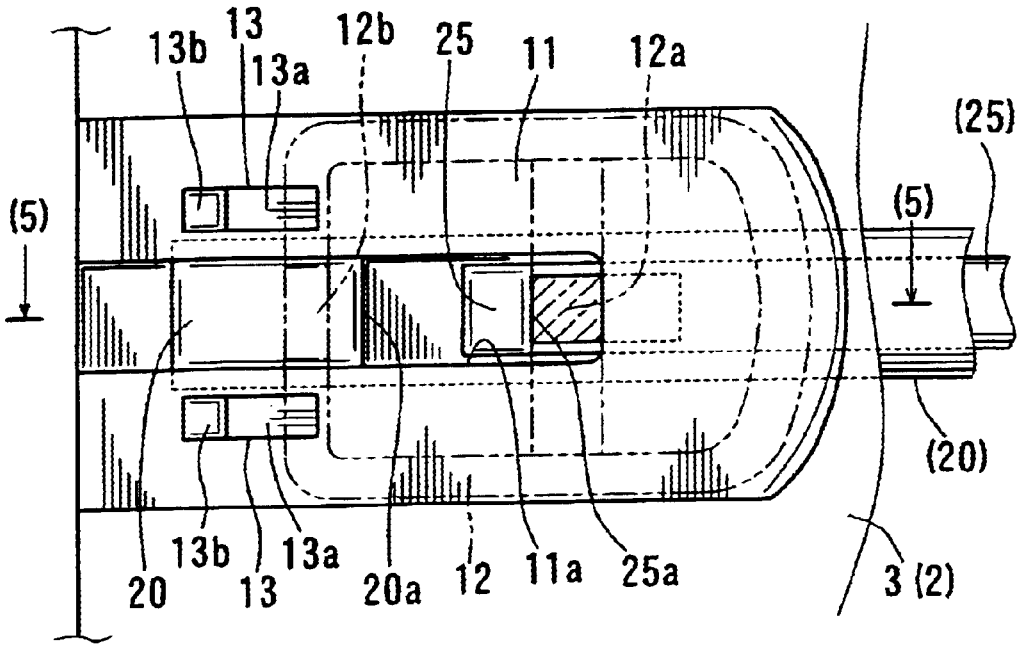
FIG. 4 is an enlarged, plan view of a switch mounting portion of a handle casing of the grinder, in which a switch lever is positioned in an OFF position when the battery is set in the grinder.
Figure 5:
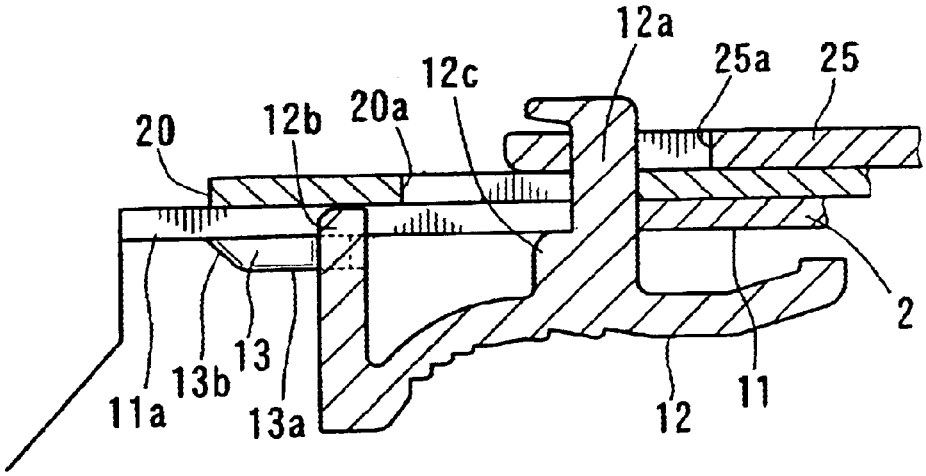
FIG. 5 is a sectional view taken along line (5)—(5) shown in FIG. 4.

Therefore, when the battery 10 has been set or mounted within the battery mounting space 9, the detection end 20*b* may be pressed forwardly by the battery 10 against the biasing force of the compression spring 21. In the case, the detection rod 20 will retract into the handle casing 3 as indicated by solid lines in FIG. 1. As shown in FIGS. 4 and 5, a slot 20*a* may be formed in the front portion of the detection rod 20 and may oppose to the slot 11*a* of the handle casing 3. The actuation arm 12*a* of the switch lever 12 may extend through both the slot 11*a* and the slot 20*a*.

Figure 6:
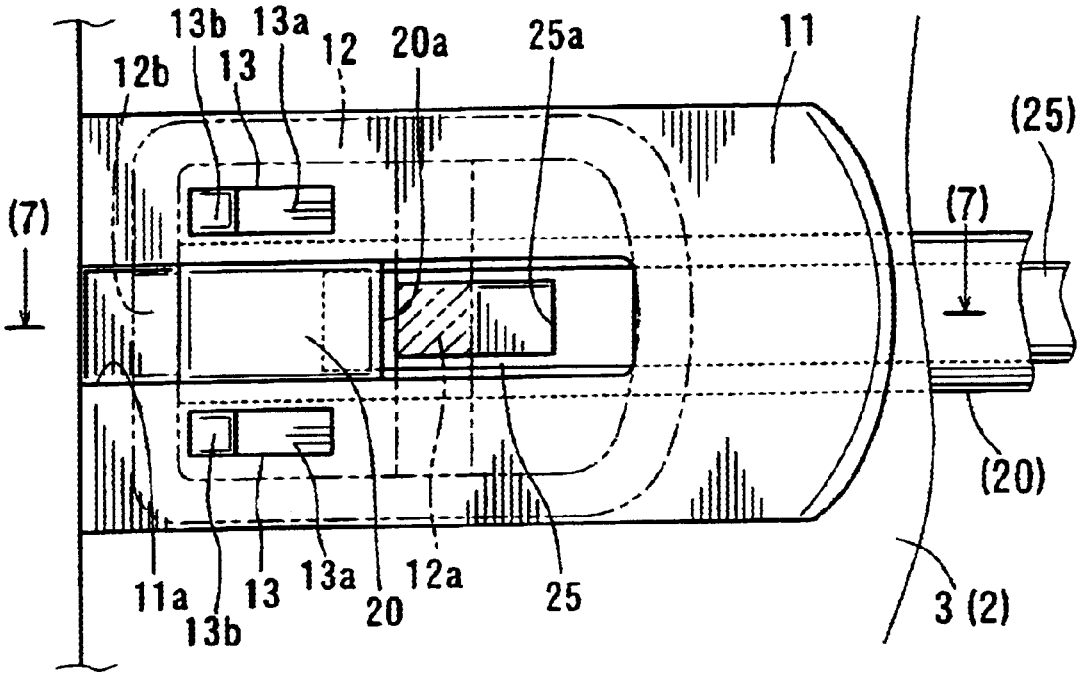
FIG. 6 is a view similar to FIG. 4, but showing the switch lever locked in an ON position when the battery is set in the grinder.
Figure 7:
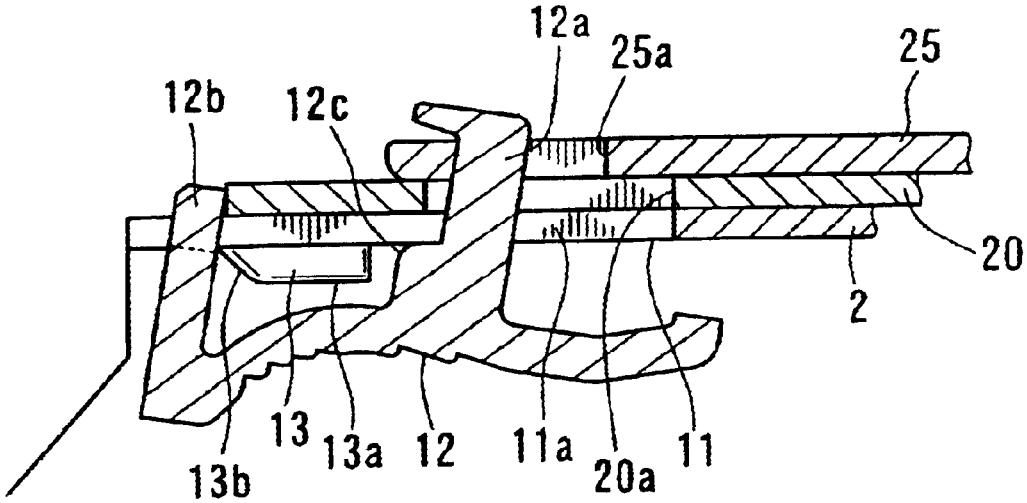
FIG. 7 is a sectional view taken along line (7)—(7) shown in FIG. 6.
Figure 8:
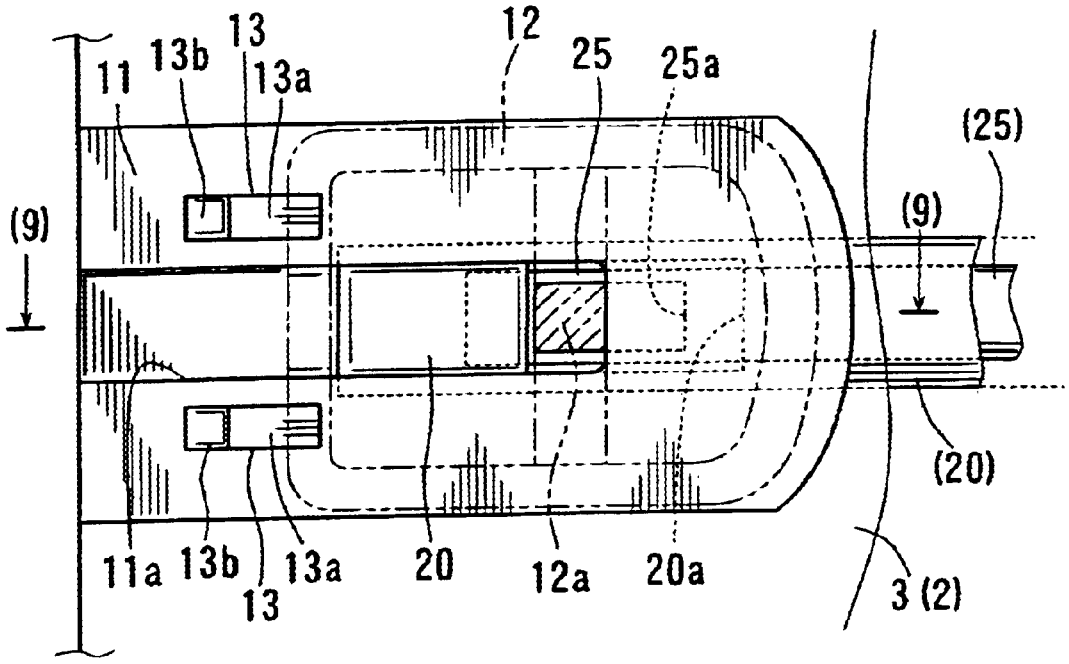
FIG. 8 is a view similar to FIG. 4, but showing the switch lever returned to the OFF position after the battery has been removed from the grinder.
Figure 9:
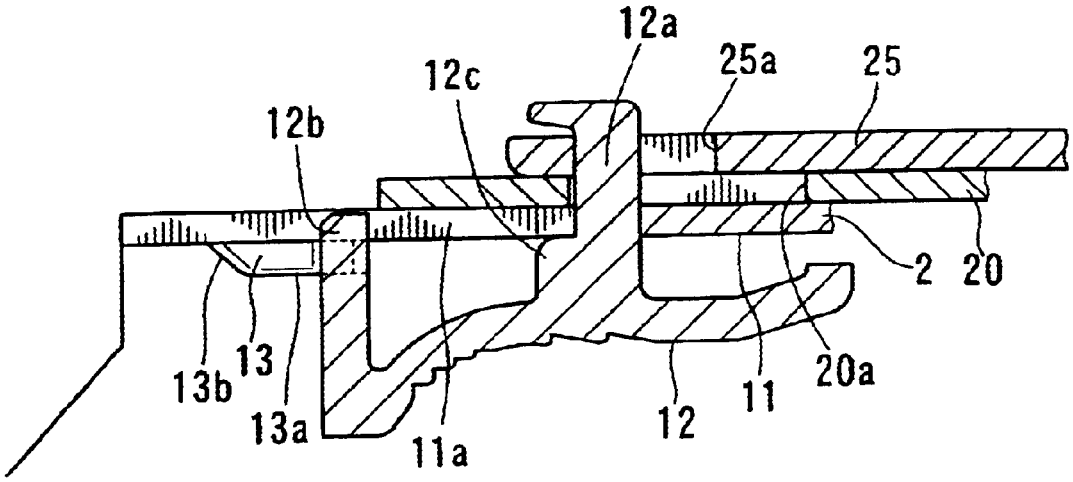
FIG. 9 is a sectional view taken along line (8)—(8) shown in FIG. 8.

Preferably, the length of the slot 20*a* in the longitudinal direction (forward and rearward directions) may be shorter than the length of the slot 11*a* in the same direction. Therefore, the switch 7 and the detection rod 20 can move relative to each other by a distance of the length of the slot 11*a* minus the thickness of the actuation arm 12*a* in the forward and rearward directions. FIGS. 4 to 7 show the state in which the detection rod 20 has been moved forward due to the pressing force applied by the battery 10 when the battery 10 is set into the battery mounting space 9. When the battery 10 has been removed, the detection rod 20 may move rearward due to the biasing force of the compression spring 21. In that case, the detection end 20*b* will extend into the battery mounting space 9 as shown in FIGS. 2, 8 and 9.

As shown in FIGS. 4 and 5, the actuation arm 12*a* also may extend through a slot 25*a* that is formed in the front portion of the switch rod 25, so that the switch rod 25 can move together with the switch lever 12 as the switch lever 12 moves forward or rearward. As shown in FIG. 1, an engaging member 25*b* may be secured to the rear end of the switch rod 25 and may engage the knob 7*a* of the switch 7. A compression spring 26 may be interposed between the engaging member 25*b* and the inner wall of the handle casing 3, so that the switch rod 25 is biased reward or in the direction towards pivoting the knob 7*a* to the OFF position. Therefore, in order to pivot the knob 7*a* to the ON position for starting the motor 6, the operator is required to manually move the switch lever 12 forward against the biasing force of the compression spring 26. When the operator releases the switch lever 12, the compression spring 26 may bias the switch lever 12 so as to automatically return the switch lever 12 to its rearward position, thereby pivoting the knob 7*a* from the ON position to the OFF position.

Further, the knob 7*a* may be held in the ON position against the biasing force of the compression spring 26. In other words, the switch lever 12 may be held in an ON position. Thus, as shown in FIGS. 6 and 7, when the switch lever 12 is in the ON position, the operator can pivot the switch lever 12 about the arc-shaped projection 12*c* that preferably contacts the outer surface of the handle casing 3. Therefore, the inner end of the engaging arm 12*b* may engage the front end of the detection rod 20 when the detection rod 20 has been pushed towards the foremost position due to insertion of the battery 10 into the battery mounting space 9.

In this pivoted position, the rearward biasing force of the spring 26 will be applied to the actuation arm 12*a*, thereby serving to reliably maintain the engagement of the engaging arm 12*b* and the front end of the detection rod 20. Therefore, the switch lever 12 can be reliably locked in the pivoted position (or the ON position) as shown in FIG. 7. As shown in FIGS. 4 and 5, when the switch lever 12 is in an OFF position, the actuation arm 12*a* of the switch lever 12 may contact the rear edge of the slot 11 a of the handle casing 3 due to the rearward biasing force of the compression spring 26 that is applied to the actuation arm 12*a* via the switch rod 25. In this OFF position, the side portions of the front end of the switch lever 12 along both sides of engaging arm 12*b* may oppose to and contact the flat surfaces 13*a* of the guide projections 13. Therefore, when the switch lever 12 is in the OFF position, the guide projections 13 may prevent the switch lever 12 from pivoting. However, when the operator moves the switch lever 12 forward, the switch lever 12 can incline while the side portions of the front end of the switch lever 12 move along the inclined surfaces 13*b* of the guide projections 13, which inclined surfaces 13*b* are formed in continuity with the flat surfaces 13 a. As a result, the switch lever 12 can incline until the side portions of the front end of the switch lever 12 contact the upper surface of the handle casing.

If the switch lever 12 held in the ON lock position shown in FIGS. 6 and 7 when the battery 10 has been completely discharged during the use of the grinder and the motor 6 has stopped rotating, the battery 10 may be removed from the battery mounting space 9 in order to be recharged. When the battery 10 is removed from the battery mounting space 9, the detection rod 20 may move rearward due to the biasing force of the compression spring 21, so that the detection end 20*b* may extend into the battery mounting space 9 as indicated by chain lines in FIG. 1. As a result, the front end of the detection rod 20 may move away from the engaging arm 12*b* of the switch lever 12, so that the engaging arm 12*b* may disengage from the detection rod 20. Subsequently, the switch lever 12 may move rearward toward the OFF position due to the biasing force of the compression spring 26, which biasing force is applied to the switch lever 12 via the switch rod 25.

Preferably, the biasing force of the compression spring 26 may be selected to provide sufficient force to cause the front end of the switch lever 12 to ride over the guide projections 13. As the switch lever 12 moves rearward, the front end of the switch lever 12 will move along the inclined surfaces 13*b* and subsequently along the flat surfaces 13*a* of the guide projections 13. Thus, the switch lever 12 will pivot to return to the original position shown in FIG. 9 from the pivoted position shown in FIG. 7.

Therefore, the engaging arm 12*b* of the switch lever 12 may be moved away from the moving path of the detection rod 20. As a result, the engaging arm 12*b* may be reliably disengaged from the detection rod 20 and may move to the OFF position, in which the actuation arm 12*a* contacts the rear edge of the slot 11*a*.

As described above, when the battery 10 is removed from the battery mounting space 9 with the switch lever 12 locked in the ON position as shown in FIGS. 6 and 7, the detection rod 20 may disengage from the engaging arm 12*b* of the switch lever 12 when the detection rod 20 moves rearward. The switch lever 12 will then move to the OFF position. Therefore, the ON lock state of the switch lever 12 can be automatically released.

In addition, the switch lever 12 cannot be locked in the ON position as long as the battery 10 is removed. Thus, the operator may shift the switch lever 12 to the ON position against the biasing forces of the compression springs 21, 26, which respectively bias the detection rod 20 and the switch rod 25. However, even if the operator pushes the front end of the switch lever 12 in order to pivot the switch lever 12, the engaging arm 12*b* will not engage the front end of the detection rod 20, because the detection rod 25 moves rearward away from the engaging arm 12*b* when the operator releases the switch lever 12. In addition, after the operator has released the switch lever 12, the switch lever 12 may automatically return to the OFF position due to the biasing forces of the compression springs 21, 26.

Thus, according to the representative grinder 1, the switch lever 12 can be locked in the ON position when the battery 10 is set or inserted into the battery mounting space 9. However, the ON lock state of the switch lever 12 can be released at the same time that the battery 10 is removed from the battery mounting state 9, because the detection rod 20 and the engaging arm 12*b* of the switch lever 12 are disengaged from each other due to the retracting movement of the detection rod 20. Therefore, the switch lever 12 always can be positioned in the OFF position when the recharged battery 10 is again set or inserted into the battery mounting space 9. As a result, the motor 6 may be reliably prevented from being accidentally driven when the recharged battery 10 is set or inserted into the battery mounting space 9, thereby improving the operability of the grinder 1.

For example, when the battery 10 is removed, the switch 7 may preferably turn OFF (or may be pivoted to the OFF position) before the electrical connection between the battery 10 and the switch 7 is interrupted. With this design, generation of electric arcs or sparks between the terminal of the battery 10 and the corresponding terminal of the grinder 7 may be reliably prevented. Therefore, the durability of the grinder 1 may be improved.

The above representative embodiment can be modified in various ways. For example, the compression spring 21 that biases the detection rod 20 rearward can be omitted. With this modification, when the battery 10 has been removed, the detection rod 20 still can move rearward. Thus, due to friction between the switch rod 25 and the detection rod 20, the detection rod 20 may move rearward together with the switch rod 25 when the switch rod 25 moves rearward due to the biasing force of the compression spring 26.

Moreover, the present ON lock mechanism can be utilized with a wide variety of DC power tools. For example, the present teachings also may be readily applied to drills, impact screwdrivers, circular saws, reciprocating saws, chain saws or any other kind of power tools that are driven by a battery as the power source.

Furthermore, the battery 10 may be disposed within a battery pack for ease of use. The battery pack may, e.g., comprise a hard resin or metal housing and may have projections and/or recesses for engaging the battery mounting space 9. Naturally, the battery mounting space may include corresponding recesses and/or projections. A variety of battery pack designs may be utilized with the present teachings.

What is claimed is:

1. A power tool comprising:

a tool body having a battery mounting space defined to receive and mount a battery, a switch electrically coupling the battery to a motor and an ON lock mechanism arranged and constructed to lock the switch in an ON position, and to automatically release the switch from the ON position when the battery is removed from the power tool.

2. A power tool as in claim 1, wherein the ON lock mechanism is further arranged and constructed to prevent the switch from being locked in the ON position after the battery has been removed from the power tool.

3. A power tool as in claim 1, wherein the ON lock mechanism comprises:

a detection rod being movable between a first position, wherein the detection rod extends into the battery mounting space, and a second position, wherein the detection rod is withdrawn from the battery mounting space when the battery is mounted within the battery mounting space, wherein the switch engages the detection rod positioned in the second position, thereby locking the switch in the ON position, and the detection rod is arranged and constructed to automatically move to the first position, thereby releasing the switch from the ON position, when the battery is removed from the battery mounting space.

4. A power tool comprising:

a body having a battery mounting space for receiving a battery, an electric motor disposed within the body, a switch electrically connected to the motor and being movable between an ON position and an OFF position for starting and stopping the motor, respectively, and an ON lock mechanism arranged and constructed to lock the switch in the ON position and to automatically release the switch from the ON position in response to removal of the battery from the power tool.

5. A power tool as in claim 4, wherein the ON lock mechanism is operable by an operator to lock the switch in the ON position, and the switch can be automatically released from the ON lock state to return to the OFF position when the battery has been removed from the battery mounting space.

6. A power tool as in claim 4, wherein the ON lock mechanism is operable to prevent the switch from being held in the ON lock position as long as the battery is removed from the power tool.

7. A power tool as in claim 4, wherein the ON lock mechanism includes a detection member that can detect whether or not the battery has been mounted on the power tool, wherein the ON lock mechanism is operable to permit the switch to be locked in the ON position or to prevent the switch from being held in the ON position in response to detection of the presence of the battery by the detection member.

8. A power tool as in claim 7, wherein the detection member comprises a detection rod that is movable between a first position for permitting the switch to be locked in the ON position and a second position for preventing the switch from being held in the ON position.

9. A power tool as in claim 8, wherein the detection member retracts from the battery mounting space when the detection member is in the first position and the detection member extends into the battery mounting space when the detection member is in the second position, whereby the battery moves the detection member from the second position to the first position when the battery is mounted within the battery mounting space.

10. A power tool as in claim 9, further including a first biasing member for biasing the detection member toward the second position.

11. A power tool as in claim 9, wherein the ON lock mechanism further includes a switch lever that is associated with the switch, the switch lever having an engaging arm that can engage the detection member so as to lock the switch in the ON position when the detection member is in the first position.

12. A power tool as in claim 11, further including a switch rod that is coupled to the switch, wherein the switch lever and switch rod are arranged and constructed to shift the switch between the ON position and the OFF position.

13. A power tool as in claim 12, further including a second biasing member that is associated with the switch lever, the second biasing member serving to bias the switch rod towards a direction that turns OFF the switch.

14. A power tool as in claim 13, wherein the detection member disengages from the engaging arm of the switch lever so as to release the switch from the ON position when the detection member moves from the second position to the first position.

15. A power tool as in claim 12, wherein the second biasing member also serves to hold the engaging arm of the switch lever in engagement with the detection rod.

16. A power tool comprising:

a body having a battery mounting space for receiving a battery, an electric motor disposed within the body, a switch electrically connected to the motor and being movable between an ON position and an OFF position for starting and stopping the motor, respectively, an ON lock mechanism arranged and constructed to releaseably lock the switch in the ON position, and an ON lock releasing mechanism arranged and constructed to automatically release the switch from the ON position and to return the switch to the OFF position, in response to removal of the battery from the battery mounting space.

17. A power tool comprising:

a housing defining a battery mounting space for receiving a battery, a tool extending from the housing, a motor disposed within the housing and driving the tool, a switch electrically coupling the battery to a motor, means for locking the switch in an ON position and for automatically releasing the switch from the ON position without operator assistance when the battery is removed from the power tool.

18. A power tool as in claim 17, wherein the locking means also prevents the switch from being locked in the ON position after the battery has been removed from the power tool.

19. A power tool as in claim 18, wherein the locking/releasing means further comprises detection means being movable between first and second positions, wherein the detection means indicates the presence of the battery within the battery mounting space in the first position and indicates the absence of the battery within the battery mounting space in the second position, wherein detection means locks the switch in the ON position when the detection means is positioned in the second position, and the detection means releases switch from the ON position when the detection means is positioned in the first position.

20. A power tool as in claim 19, wherein the locking/releasing means further comprises:

a first spring biasing the detection means toward the second position, a switch lever coupled to the switch and having an engaging arm that is arranged and constructed to engage the detection means so as to lock the switch in the ON position when the detection means is in the first position, a switch rod coupled to the switch, wherein the switch lever and switch rod are arranged and constructed to shift the switch between the ON position and the OFF position, and a second spring biasing the switch rod towards a direction that turns OFF the switch, the second spring also being disposed to hold the engaging arm of the switch lever in engagement with the detection means, and wherein the detection means disengages from the engaging arm of the switch lever so as to release the switch from the ON position when the detection means moves from the second position to the first position.

* * * * *